US006886277B2

(12) United States Patent
Yukawa et al.

(10) Patent No.: US 6,886,277 B2
(45) Date of Patent: May 3, 2005

(54) SMALL SWIVEL TYPE WORKING VEHICLE

(75) Inventors: Katsuhiko Yukawa, Izumi (JP); Takafumi Wada, Kishiwada (JP); Masanori Shintani, Tondabayashi (JP); Junichi Fujiwara, Osaka (JP)

(73) Assignee: Kubota Corporation, Osaka (JP)

( * ) Notice: Subject to any disclaimer, the term of this patent is extended or adjusted under 35 U.S.C. 154(b) by 75 days.

(21) Appl. No.: 10/229,945

(22) Filed: Aug. 28, 2002

(65) Prior Publication Data

US 2003/0154635 A1 Aug. 21, 2003

(30) Foreign Application Priority Data

Feb. 15, 2002 (JP) ..... 2002-038555
Feb. 15, 2002 (JP) ..... 2002-038557
Feb. 15, 2002 (JP) ..... 2002-038558

(51) Int. Cl.[7] ..... E02F 5/00
(52) U.S. Cl. ..... 37/347; 414/687
(58) Field of Search ..... 37/347, 348, 142.5; 414/694, 695.5, 635, 680, 687, 688, 685; 212/300, 231, 232

(56) References Cited

U.S. PATENT DOCUMENTS

| | | | | |
|---|---|---|---|---|
| 3,606,047 A | | 9/1971 | Schaeff | |
| 4,771,855 A | | 9/1988 | Takashima et al. | |
| 4,966,240 A | | 10/1990 | Aikawa | |
| 5,638,908 A | | 6/1997 | Masumoto et al. | |
| D387,360 S | * | 12/1997 | Ishizaki et al. | D15/25 |
| 5,975,833 A | * | 11/1999 | Yamada et al. | 414/687 |
| D424,581 S | * | 5/2000 | Morita et al. | D15/24 |
| D450,067 S | * | 11/2001 | Murakami et al. | D15/25 |
| D450,331 S | * | 11/2001 | Murakami et al. | D15/25 |
| D460,974 S | * | 7/2002 | Murakami et al. | D15/25 |

FOREIGN PATENT DOCUMENTS

| | | |
|---|---|---|
| GB | 2180522 A | 4/1987 |
| JP | 61014323 | 1/1986 |
| JP | 4-216722 | 8/1992 |
| JP | 8-134948 | 5/1996 |
| JP | 09003953 | 1/1997 |
| JP | 09021145 | 1/1997 |
| JP | 09095975 | 4/1997 |
| JP | 09105147 | 4/1997 |
| JP | 09158249 | 6/1997 |
| JP | 11093217 | 4/1999 |
| JP | 2001323513 | 11/2001 |

OTHER PUBLICATIONS

DE–Z "bpz", Nr. 10/98, Seiten 48, 51, 52.

* cited by examiner

*Primary Examiner*—Robert E Pezzuto
(74) *Attorney, Agent, or Firm*—Webb Ziesenheim Logsdon Orkin & Hanson P.C.

(57) ABSTRACT

A small swivel type working vehicle includes a running device (4), a swivel base (2) mounted on the running device (4) to be swivelable about a vertical swivel axis (X), a driver's seat (5) mounted on the swivel base (2), a control box (6) mounted upright on a top surface of the swivel base (2) forwardly of the driver's seat (5), a swing bracket (18) supported to be swingable about a vertical pivotal axis **(19*a*) by a flange unit (17) provided at a front end of the swivel base (2), a boom (20) attached to the swing bracket to be swingable about a horizontal shaft (22), and a boom cylinder (21) connected at one end thereof to the swing bracket (18) and at the other end to the boom (20) for swinging the boom (20). The boom cylinder (21) is disposed outside the boom (20) to extend along a rear surface thereof. A walk-through space (100) is defined between the control box (6) and the driver's seat (5). A distance (L1) from the swivel axis (X) of the swivel base (2) to the vertical pivotal axis (19*a*) is substantially the same as a distance (L2) from the swivel axis (X) to a rear end of the swivel base(2)**.

18 Claims, 6 Drawing Sheets

SMALL SWIVEL TYPE WORKING VEHICLE

BACKGROUND OF THE INVENTION

1. Field of the Invention

This invention relates to a small swivel type working vehicle, particularly a small backhoe, comprising a running device, a swivel base mounted on the running device to be swivelable about a vertical swivel axis, a driver's seat mounted on the swivel base, a control box mounted upright on a top surface of the swivel base forwardly of the driver's seat, a swing bracket supported to be swingable about a vertical pivotal axis by a flange unit provided at a front end of the swivel base, a boom attached to the swing bracket to be swingable about a horizontal shaft, and a boom cylinder connected at one end thereof to the swing bracket and at the other end to the boom for swinging the boom.

2. Description of the Related Art

A small backhoe of the type described above is known from Japanese Patent Publication Kokai No. 8-134948, for example.

It is easy for a large or midsize backhoe with a sufficiently large swivel base to secure an accommodation space around the driver's seat and a walk-through space enabling the driver to board and alight from the backhoe at opposite lateral sides. With a small backhoe, however, it is difficult to be capable of normal operations while securing such spaces noted above. Attempts to secure minimum accommodation and walk-through spaces result in disadvantages of a bad fore and aft balance of the swivel base and a reduced swing angle of the boom. Particularly, securing an appropriate walk-through space is closely related to a layout of the control box on the swivel base.

The conventional backhoe generally includes numerous control valves for controlling supply of pressure oil to actuators such as right and left propelling motors, a swivel motor, a dozer cylinder, a boom cylinder, an arm cylinder, a bucket cylinder, a swing cylinder and the like, and a control device for controlling the control valves. The control device is mounted in the control box while the control valves are arranged inside the swivel base remote from the control box.

Transmission of operating forces from the control device to the control valves may be made either through links and rods operatively connected to control levers, as in the case of mechanical control valves such as control valves for the right and left propelling motors, for the dozer, for swinging and the like, or by operating pilot valves through control levers to control hydraulic control valves such as those for swiveling, for the boom and arm and the like by pilot pressure.

To control the control valves by pilot pressure requires frequent and delicate operations, and the numerous valves mounted within the control box are controlled by a pair of right and left control levers.

The control box accommodates only the control device and the control valves are mounted within the swivel base remote from the control box. Thus, the control box per se is not required to have such a large fore and aft dimension, and may allow a large distance between the rear surface of the control box and the driver's seat to secure space around the driver's feet. However, the control valves are mounted within the swivel base remote from the control box, which hampers a compact arrangement as a whole. Further, since a piping space is required, simplification of the structure becomes difficult. In addition, when the control valves are provided within the swivel base, a space for accommodating the control valves limits a space for accommodating the oil tank, fuel tank or the like within the swivel base.

As one solution, it is conceivable to arrange the control valves below the control device in the control box. However, an arrangement of the control valves within the control box results in an increased fore and aft dimension of the control box. An ultra-small swivel type backhoe in particular allows on a very small distance from the driver's seat to an excavating assembly. Where the control box disposed therebetween has a large fore and aft dimension, the walk-through space is reduced to impair mobility of the driver. Further, the control device could hamper assembly and maintenance of upper portions of the control valves.

SUMMARY OF THE INVENTION

The object of the invention is to provide a small swivel type working vehicle with a control box of improved structure and layout for securing a sufficient walk-through space. In that case, care must be taken to maintain a good fore and aft balance of a swivel base and a sufficiently large swing angle of a boom.

The above-noted object is fulfilled, according to this invention, by a small swivel type working vehicle comprising a running device, a swivel base mounted on the running device to be swivelable about a vertical swivel axis, a driver's seat mounted on the swivel base, a control box mounted upright on a top surface of the swivel base forwardly of the driver's seat, a swing bracket supported to be swingable about a vertical pivotal axis by a flange unit provided at a front end of the swivel base, a boom attached to the swing bracket to be swingable about a horizontal shaft, and a boom cylinder connected at one end thereof to the swing bracket and at the other end to the boom for swinging the boom, in which the boom cylinder is disposed outside the boom to extend along a rear surface thereof, a walk-through space is defined between the control box and the driver's seat, and a distance from the swivel axis of the swivel base to the vertical pivotal axis is substantially the same as a distance from the swivel axis to a rear end of the swivel base.

With this structure, a good fore and aft balance of the swivel base may be maintained even if the swivel base is diminished while securing a minimum required walk-through space. A sufficient swing angle may also be set for the boom while positioning the boom and boom cylinder as dose to the front of the control box as possible.

Where the control box has a front end positioned between the vertical pivotal axis and a front end of the swivel base, the space between the driver's seat and control box is enlarged in a corresponding relationship to an amount of forward projection of the control box from the swivel base. Thus, a sufficient walk-through space may be secured despite the diminished swivel base.

The control box may have a convex front surface and a concave rear surface. Then, the space between the driver's seat and control box, and thus the walk-through space, may be enlarged with ease.

Further, the boom may be in the form of a substantially hollow rectangular box having a cross section with an aspect ratio substantially of 1 to 1. Then, a sufficient swing angle may be secured for the boom even though the control box is disposed further forwardly of the swivel base.

In a preferred embodiment of this invention, the control box includes a pair of right and left frame side plates fixed to the swivel base at lower ends thereof, a control valve assembly mounted in an intermediate portion of an equipment accommodating space produced by the pair of right and left frame side plates, a manifold disposed above the control valve assembly, and a control device disposed above the manifold. With this construction, the control device, the control valve assembly and manifold are connected to the right and left frame side plates like cross members, which constitute a frame structure as a whole. Consequently, good strength may be obtained by mutual reinforcement between these members despite its simple structure.

Where the control device includes a pair of right and left control levers, it is proposed that these control levers are fixed to a frame upper plate supported by the right and left frame side plates in order to realize a simple attachment of the levers to the frame side plates.

In another preferred embodiment of this invention, the control valve assembly control valve assembly has a vertical center line displaced forwardly of a center line of the control device, and each of the frame side plates has an upper portion displaced rearwardly of a lower portion thereof and an intermediate portion displaced forwardly of the lower portion. This construction allows a piping operation to be carried out easily for the upper portion of the control valve assembly without being obstructed by the control device. Besides, lateral side portions forwardly of the control device and lateral side portions rearwardly of the control valve assembly may be exposed without being obstructed by the right and left frame side plates, which facilitates maintenance of the portions forwardly of the control device and rearwardly of the control valve assembly. In addition, the accommodating space around the driver's feet between the driver's seat and the control box is enlarged, which results in a satisfactory walk-through space.

In a further preferred embodiment of this invention, the control valve assembly includes vertically extending spools in order to facilitate a piping operation around the control valve assembly. Pipes for connecting the control valve assembly to the control device are provided forwardly and upwardly of the control valve assembly.

In a still further preferred embodiment of this invention, the swing bracket is disposed above the running device and has a pivotal axis positioned rearwardly of a front roller axis of a crawler device constituting the running device. An ultra-small backhoe is required to have a total body length reduced as much as possible while maintaining an excellent weight balance. Thus, in a normal position (with the boom facing straight forward as shown in FIG. 1), the swing bracket is disposed in a space defined by the front end of the swivel base and the top surface of the crawler device, and has its pivotal axis positioned rearwardly of the front roller axis. This realizes an ultra-small vehicle capable of carrying out a stable bucket operation.

Similarly, in order to comply with the requirement for keeping a good weight balance of the ultra-small backhoe while reducing the entire length of the vehicle, this invention proposes a layout to arrange the rear end of the swivel base coinciding with a rear roller axis of the crawler running device.

Other features and advantages of this invention will be apparent from the following description of an embodiment to be taken with reference to the drawings.

DESCRIPTION OF THE PREFERRED EMBODIMENT

An embodiment of this invention will be described hereinafter with reference to the drawings.

Figure 1:
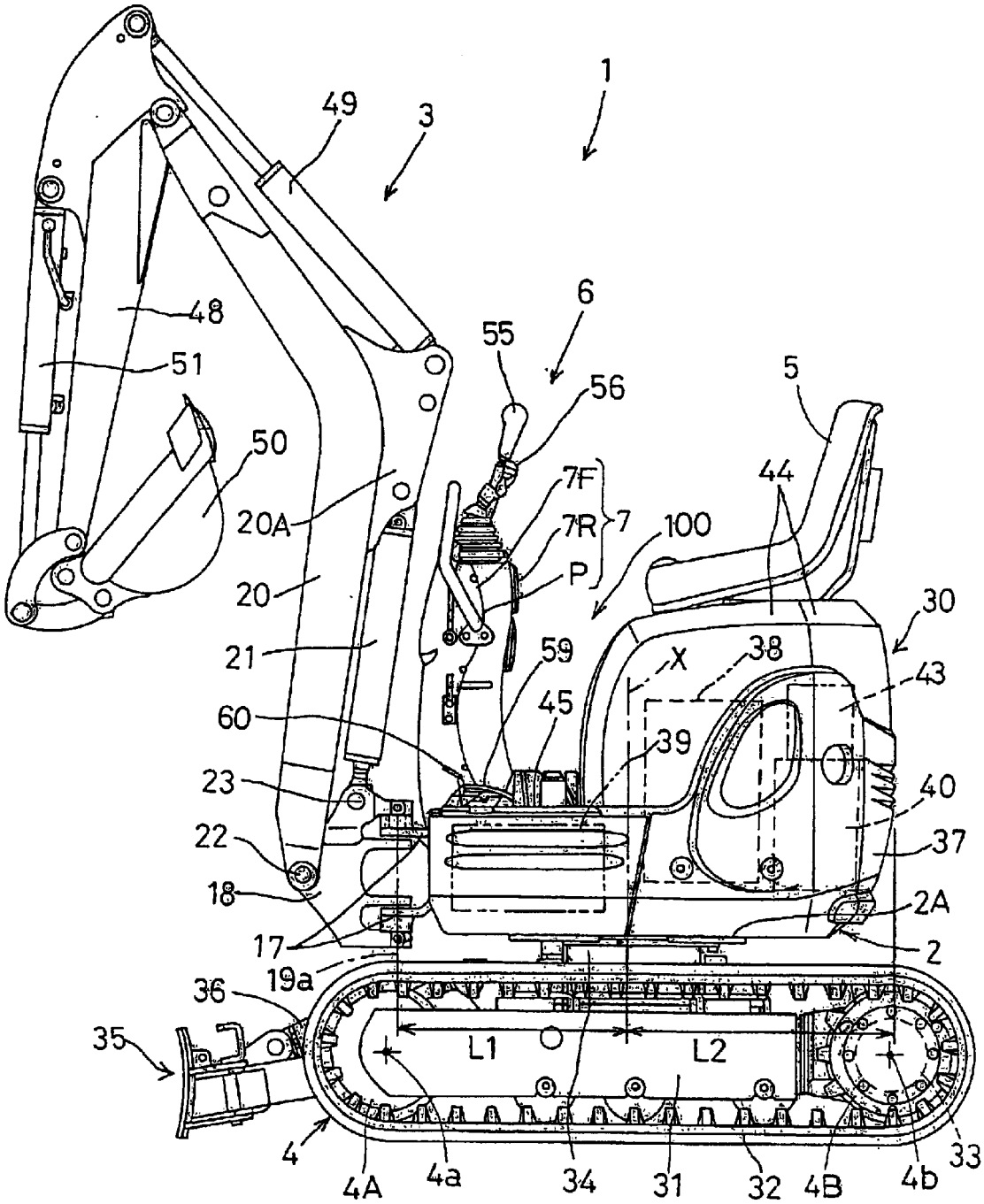
FIG. 1 is a side elevation of a backhoe which is one example of swivel type working vehicles according to this present invention.
Figure 2:
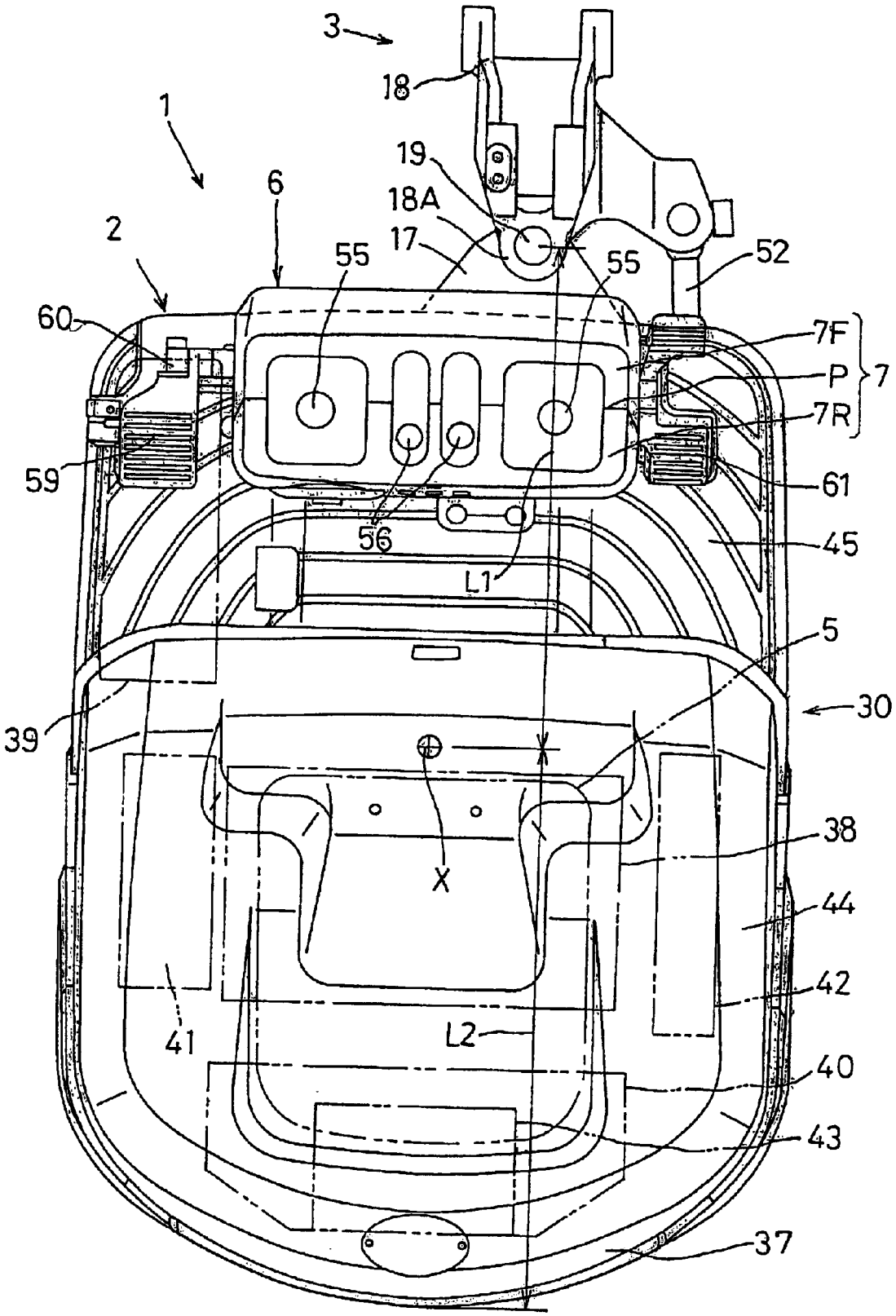
FIG. 2 is a plan view of the backhoe shown in FIG. 1.
Figure 3:
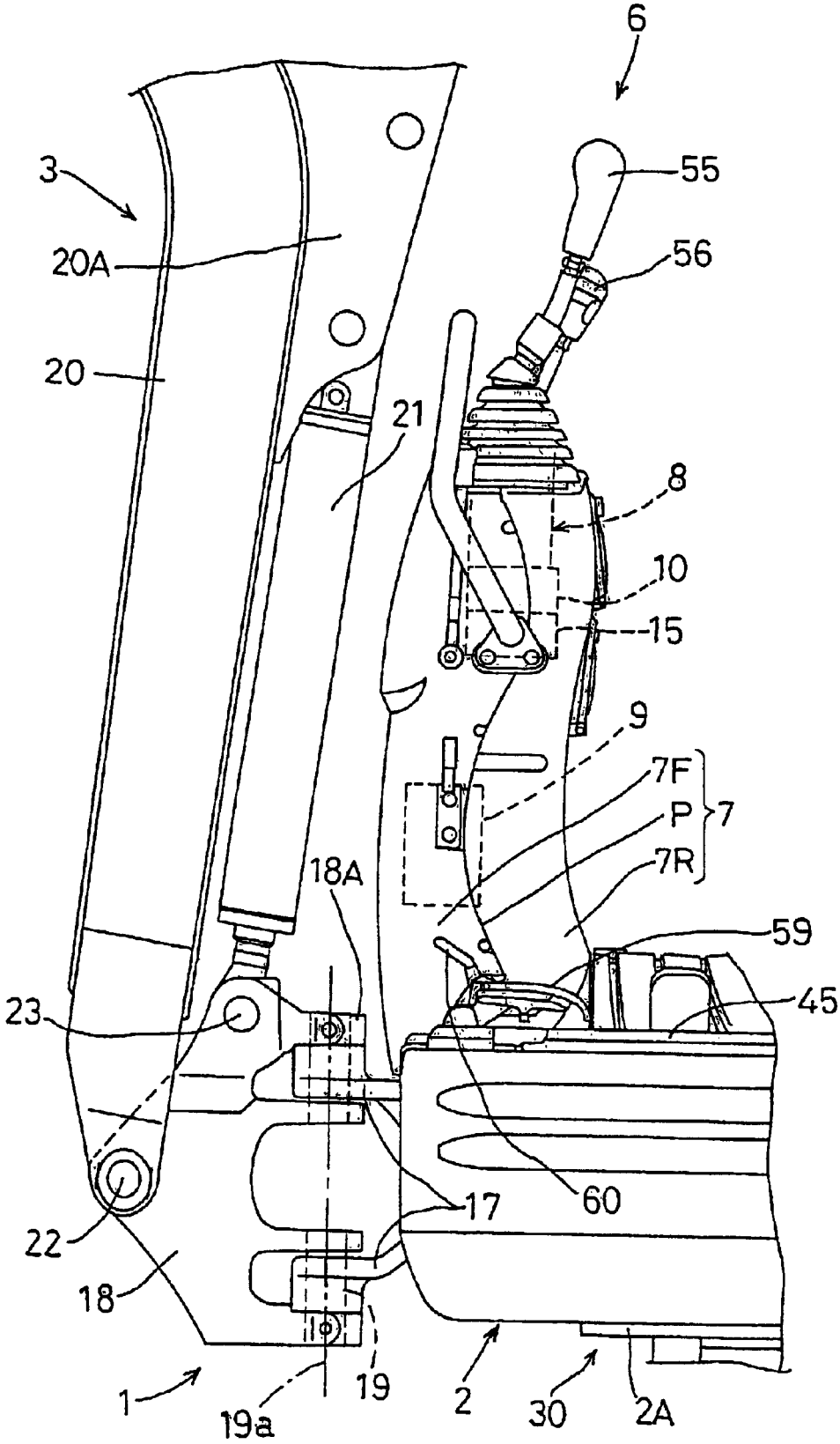
FIG. 3 is a side view illustrating a front portion of the backhoe shown in FIG. 1.
Figure 4:
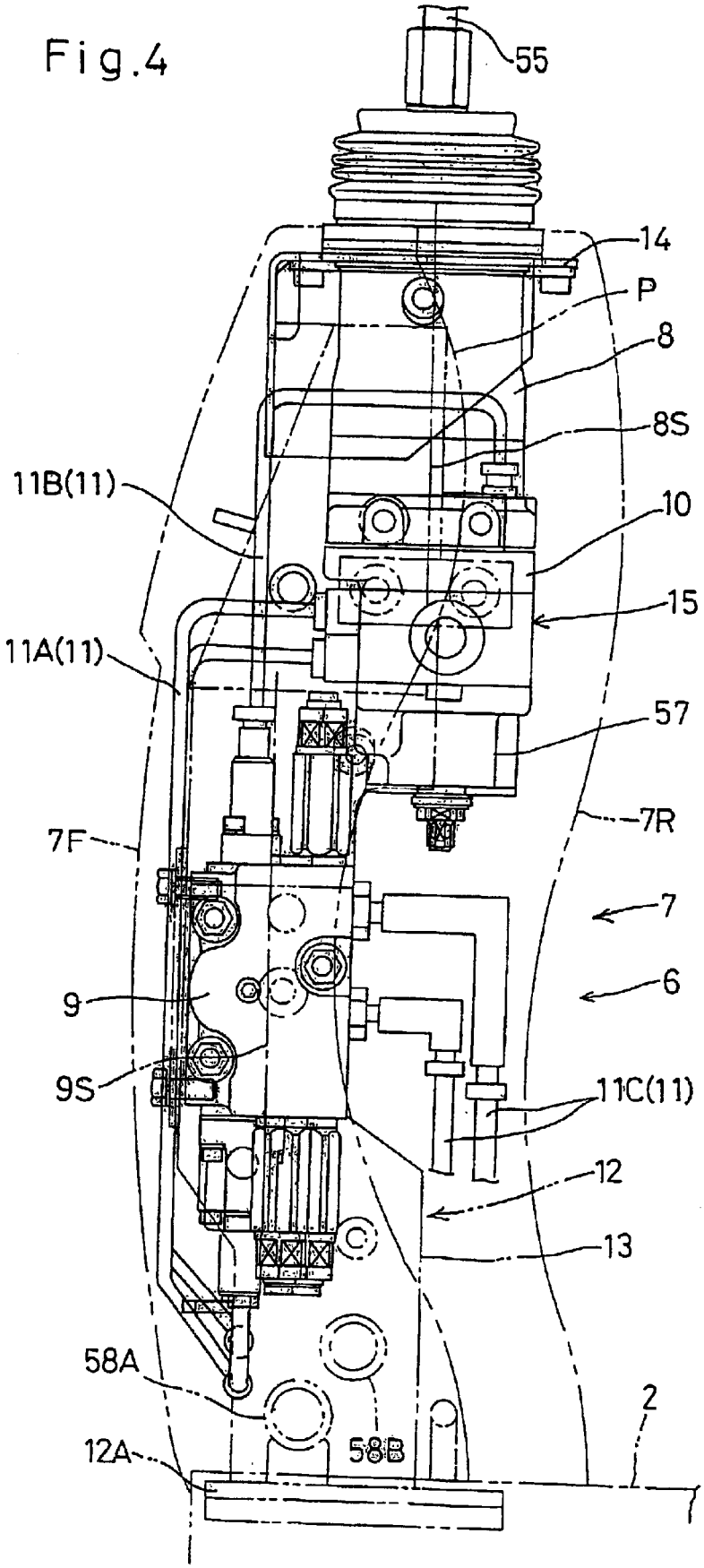
FIG. 4 is a side view of a control box.
Figure 5:
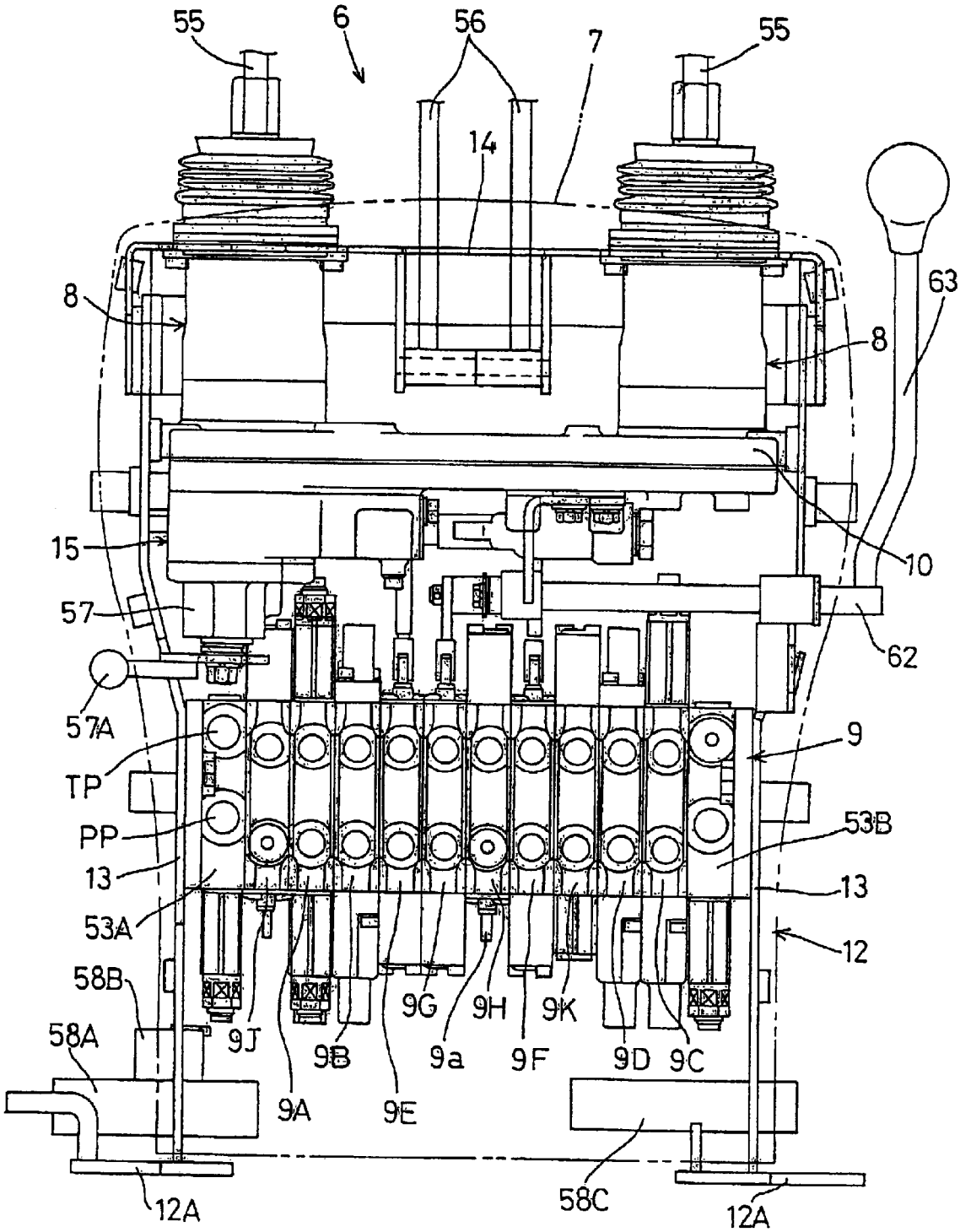
FIG. 5 is a rear view of the control box.

FIGS. 1 and 2 show an ultra-small backhoe 1 exemplify a swivel type working vehicle. The backhoe 1 includes crawlers 4 acting as a running device, a swivel base 2, and an excavating assembly 3 mounted on the swivel base 2.

Each crawler 4 includes a front roller 4A rotatable about an axis 4*a* at a front portion one of right and left side frames 31 constituting a track frame, a rear roller 4B rotatable about an axis 4*b* at a rear portion of the side frame 31, and a rubber or steel crawler belt 32 wound around these rollers. The rear rollers 4B act as drive rollers driven by right and left hydraulic propelling motors.

The track frame supports the right and left side frames 31 to be movable sideways by hydraulic cylinders. The crawlers 4 are the variable width (tread width) type.

When the crawlers 4 assume a maximum width position, a distance from a swivel axis X to an outer edge of each crawler 4 is substantially the same as or slightly (about 10%) larger than the largest radius of the swivel base 2.

When the crawlers 4 assume a minimum tread position, a distance from the swivel axis X to the outer edge of each crawler 4 is substantially the same as, or slightly (about 10%) larger than a distance from the swivel axis X to a right or left side of the swivel base 2.

The swivel base 2 is mounted on the track frame through a swivel bearing 34 to be swivelable sideways about the swivel axis X by a swivel motor. The track frame includes a dozer 35 attached to the front thereof to be vertically movable by a dozer cylinder 36.

The swivel base 2 has a base plate 2A to which a frame, vertical walls, a support deck and the like are welded, and a balance weight 37 mounted on a rear end thereof which defines a rearmost end of the swivel base 2.

The swivel base 2 has, arranged thereon, an engine 38, a fuel tank 39, an oil tank 40, hydraulic pumps 41 driven by the engine 38, a radiator 42, a battery 43 placed on the oil tank 40, a hood 44 covering these components, a driver's seat 5 mounted on the hood 44, and a control box 6 disposed forwardly of the driver's seat 5. The swivel base 2 and the above components arranged on the swivel base 2 are collectively referred to as an upper structure 30.

The oil tank 40 is mounted within or forwardly of the balance weight 37. The hydraulic pumps 41 include a pilot pressure hydraulic pump for supplying pilot oil to a control device as well as a main pump for supplying pressure oil to various actuators.

A footrest 45 is disposed on an upper surface of the swivel base 2 forwardly of the driver's seat 5. A flange unit 17 is formed at a front end of the swivel base 2. The excavating assembly 3 has a swing bracket 18 attached to the flange unit 17 to be swingable about a vertical shaft 19 having an axis 19*a*.

As seen from FIG. 1, the swing bracket 18 is disposed above the crawlers 4, and the vertical shaft 19 of the swing bracket 18 is disposed rearwardly of the front roller axis 4*a*. The rear end of the swivel base 2 substantially coincides with the rear roller axis 4*b*.

As seen from FIGS. 3 through 6, the control box 6 is disposed on a front portion of the swivel base 2 forwardly of the driver's seat 5. The control box 6 contains substantially all components necessary for controlling the backhoe. Numeral 12 in FIGS. 4 and 5 denotes a frame structure gate-shaped in front view. The frame structure 12 includes a pilot valve assembly 8 acting as the control device and an oil passage manifold 10 mounted in an upper portion thereof, a control valve assembly including a number of control valves 9 mounted in an intermediate portion below the oil passage manifold 10, and pedal elements supported at a lower portion thereof. These components are covered by a box enclosure 7.

The pilot valve assembly 8 and control valve assembly 9 housed in the box enclosure 7 are not placed in the same position in a fore and aft direction. That is, a vertical center line 9S of the control valve assembly 9 is displaced (offset) forwardly from a center line 8S of the pilot valve assembly 8.

The control valve assembly 9 includes spools 9*a* arranged in substantially middle positions in the fore and aft direction of valve bodies. Hydraulic pipes for pilot pressure oil and links are connected to upper and lower ends of the spools 9*a*. When the control valve assembly 9 is disposed directly under the pilot valve assembly 8 and manifold 10, these components hamper connection of the pipes and links.

As described above, the control valve assembly 9 is slightly displaced forwardly from the pilot valve assembly 8. This arrangement alone facilitates a piping operation to be carried out above the control valve assembly 9 Further, a distance from the driver's seat 5 to the control valve assembly 9 is increased by an amount of forward displacement of the control valve assembly 9. A space essential for free movement of the driver's feet may thereby be increased even though pipes 11C are connected rearwardly of the control valve assembly 9. As a result, a walk-through space 100 defined between the control box 6 and the driver's seat 5 is also enlarged.

More particularly, the control box 6 has a rear surface (rear surface of a rear cover 7R) formed concave by displacing the control valve assembly 9 forwardly. This creates a pocket rearwardly of the control box 6 in a vertically intermediate portion thereof while the control box 6 has the same fore and aft dimension as in the prior art. Thus, the distance from the control box 6 to the driver's seat 5 is increased to enlarge the walk-through space 100.

The control valve assembly 9 is connected to the manifold 10 through pipes 11. Specifically, pipes 11A connected to lower positions of the control valve assembly 9 extend along a front surface of the control valve assembly 9. Pipes 11B connected to upper positions of the control valve assembly 9 extend substantially straight upward from the control valve assembly 9. The pipes 11C for connecting the control valve assembly 9 to the hydraulic pumps 41 and the oil tank 40 extend downward from the rear surface of the control valve assembly 9. These pipes 11 may be laid or maintained by removing the box enclosure 7.

With the control valve assembly 9 displaced forwardly, the frame structure 12 includes right and left frame side plates 13 each having an upper portion displaced rearwardly and an intermediate portion displaced forwardly with respect to a lower portion thereof in side view. As a result, lateral sides forwardly of the pilot valve assembly 8 and lateral sides rearwardly of the control valve assembly 9 are exposed without being obstructed by the frame structure 12. This facilitates maintenance of a front portion of the pilot valve assembly 8, an upper portion of the control valve assembly 9, and a lower portion of the pilot valves 9 and a rear portion of the control valve assembly 9.

The box enclosure 7 has a front cover 7F and a rear cover 7R. These covers may be separated in the fore and aft direction and attached to the swivel base 2 to be removable individually. A fore-and-aft split line P is defined between the covers 7F and 7R to have an intermediate portion positioned forwardly of an upper portion thereof. More particularly, the covers have approximately S-shaped side surfaces (with the right cover having an S-shaped side surface and the left cover having an inverted S-shaped side surface), and the split edge between the front cover 7F and rear cover 7R has a wave-shape and not an angular shape.

Having the approximately S-shape, the fore-and-aft split line P of the box enclosure 7 passes through middle positions in the fore and aft direction of the pilot valve assembly 8 and the control valve assembly 9 in side view, respectively. Thus, the front and rear portions of the pilot valve assembly 8 and the control valve assembly 9 may be inspected and maintained without being obstructed by the rear cover 7R when the front cover 7F is removed, and without being obstructed by the front cover 7F when the rear cover 7R is removed.

With the fore-and-aft split line P having the approximately S-shape, the front portion of the pilot valve assembly 8 and the upper lateral side portion of the control valve assembly 9 are largely exposed when the front cover 7F is opened. The lower portion of the pilot valve assembly 8 and the rearward lateral side portion of the control valve assembly 9 are largely exposed when the rear cover 7R is opened. Thus, the front portion or rear portion is not entirely exposed from top to bottom, but selectively exposed to inspect and maintain a portion requiring maintenance more easily.

With the control valve assembly 9 displaced forwardly, the control box 6 has a front surface thereof (a front surface of the front cover 7F) bulging from the front of the swivel base 2 to define a convex surface. Since the entire control box 6 is displaced further forward than in the prior art, the distance from the front of the driver's seat and the hood 44 to the rear surface of the control box 6 is increased to enlarge the walk-through space 100.

The control box 6 includes a flaring upper portion and tapered from intermediate to lower portions in front view. This allows pedals 59, 60, 61 to be arranged within a limited transverse range adjacent the lower portion of the control box 6.

The pilot valve assembly 8 consists of a pair of right and left valves attached to a frame upper plate 14. The frame upper plate 14 has opposite ends fixed to the right and left frame side plates 13. The manifold 10 is connected to the upper portions of the right and left frame side plates 13, and the control valve assembly 9 is connected to the intermediate portions of the side plates 13. Thus, not only being the gate-shape, the frame structure 12 has the right and left frame side plates 13 interconnected through the control valve assembly 9 and manifold 10 at the two intermediate portions thereof The control valve assembly 9 includes two types of valves, i.e. hydraulic valves (which are hydraulically operated by pilot pressure) and mechanical valves (which receive operating forces through links and the like). The control valve assembly 9 includes numerous valves juxtaposed sideways as seen from the driver's seat 5. The spools 9*a* of the valves are oriented vertically and arranged parallel to one another.

The control valve assembly 9 includes, for example, a swivel valve 9A for the swivel motor, an arm valve 9B for an arm cylinder 49, a boom valve lift valve) 9C for a boom cylinder 21, a bucket valve (scooping/dumping valve) 9D for a bucket cylinder 51, a left propelling valve 9E and right propelling valve 9F for right and left propelling motors 33, a dozer valve 9G for a dozer cylinder 36, a changeover valve 9H for service ports, a change speed valve 9J for the right and left propelling motors 33, and a swing valve 9K for a swing cylinder 52 for swinging the swing bracket 18. All of these control valves are mounted adjacent to one another for controlling the various actuators provided for the backhoe 1. An order of arrangement of these valves is determined as appropriate.

The left propelling valve 9E, right propelling valve 9F, dozer valve 9G, change speed valve 9J and changeover valve 9H are the mechanical control type manually operable through links, arms and control levers or pedals.

On the other hand, the swivel valve 9A, arm valve 9B, boom valve 9C, bucket valve 9D and swing valve 9K require frequent and delicate controls and thus comprise the pilot pressure hydraulic type hydraulically operable by pilot pressure supplied from the hydraulic pump 41 driven by the engine 38.

Blocks 53A and 53B are connected to opposite sides of the control valves 9A through 9K to hold the valves therebetween. Each of the blocks 53A and 53B defines a pump port PP and a tank port TP to which a main pipe and a drain pipe (the pipes 11C shown in FIG. 4) are connected, respectively.

The control valves 9A through 9K and the right and left blocks 53A and 53B are sandwiched between the pair of right and left frame side plates 13, and serve to connect the right and left frame side plates 13 at a vertical intermediate portion.

The oil passage manifold 10 has an upper surface having the right and left pilot valves 8 fixed thereto, and a lower surface having an oil passage switching unit 15 attached thereto for selecting oil passage connecting patterns between the pilot valves 8 and the control valves 9A through 9K The oil passage manifold 10 includes one intermediate plate and two blocks opposed to each other to hold the intermediate plate therebetween. The manifold also includes a number of oil passages between the pilot valves 8 and the oil passage switching unit 15.

Each of the right and left pilot valves 8 has a control lever 55. The left control lever 55 is used for swiveling and for operating an arm, while the right control lever 55 is used for operating the boom and bucket. The control levers 55 are oscillatable sideways and back and forth, respectively. Each pilot valve 8 has two valve closure members operable selectively or simultaneously by reciprocating movement of the lever in one direction.

The frame upper plate 14 is fixed at the opposite ends thereof to upper positions of the right and left frame side plates, and supports right and left running control levers 56 as well as the pilot valve assembly 8. The right and left running control levers 56 constitute part of the control device and are connected to the spools of the right and left propelling valves 9E and 9F through links or arms.

The oil passage switching unit 15 serves to select oil passages between the pilot valve assembly 8 and the control valve assembly 9 to change combinations of the passages. This unit has a flat body holding a spool therein to be axially slidable by a switching lever provided externally of the unit body.

An unload valve 57 is attached to a lower surface of the oil passage manifold 10 and connected parallel to a pilot oil passage extending from the hydraulic pumps 41 to the pilot valve assembly 8. Numeral 57A denotes a control lever for the unload valve 57 which is pivotable to drain the pilot pressure oil to prevent operation of the pilot valve assembly 8. Thus, the excavating assembly 3 is not actuated when the control levers 55 are inadvertently operated.

The right and left frame side plates 13 include base plates 12A at the lower ends thereof, respectively, to be attached to the swivel base 2. Tubular members 58A and 58B are provided adjacent to the left base plate 12A. The tubular member 58A pivotably supports a pedal pivot shaft operatively connected to the changeover valve 9H, to which shaft the service pedal 59 is attached. The tubular member 58B pivotably supports a pedal pivot shaft operatively connected to the change speed valve 9J. A change speed pedal 60 is attached to the pedal pivot shaft for shifting between first speed and second speed.

A tubular member 58C is provided adjacent to the right base plate 12A for pivotably supporting a pedal pivot shaft operatively connected to the swing valve 9K. A swing pedal 61 is attached to this pedal pivot shaft.

A lever shaft 62 is pivotably supported by an intermediate portion of the right frame side plate 13 and the manifold 10 through a stay. A dozer control lever 63 for controlling the dozer valve 9G is mounted at an outer end of the lever shaft 62.

The excavating assembly 3 includes the swing bracket 18 supported by the flange unit 17 through the vertical shaft 19, a boom 20 connected to the swing bracket 18 to be oscillatable about a horizontal shaft 22, the boom cylinder 21 pivotally supported at one end thereof by the swing bracket 18 through a horizontal shaft 23 and pivotally connected at the other end to the boom 20, an arm 48 pivotally supported by a distal end of the boom 20 to be oscillatable by the arm cylinder 49, and a bucket (working implement) 50 pivotally supported by a distal end of the arm 48 to be operable by the bucket cylinder 51 for scooping (scraping) and dumping action.

The flange unit 17 includes two bracket plates spaced from each other and projecting forward from the front surface (front edge) of the swivel base 2 forwardly of the control box 6. The control box 6 is located in the substantially middle position transversely of the swivel base 2, while the flange unit 17 is displaced rightward or leftward.

A distance L1 from the swivel axis X to the front end of the flange unit 17 or the vertical shaft 19 is substantially the same as or smaller than a distance L2 from the swivel axis X to the rear end of the swivel base 2. Preferably, the distances L1 and L2 are substantially the same as or smaller than a distance from the swivel axis X to the outer edge of each crawler belt 32 when the crawlers 4 assume a wide-tread position.

Since the swivel type working vehicle 1 is small, the swivel base 2 is also very small. The swivel base 2 is about twice as wide as the standard-size driver's seat 5 or less. The front of the driver's seat 5 is positioned dose to the swivel axis X, and the engine 38 is also positioned so dose to the swivel axis X that the hood 44 has a front portion thereof lying forwardly of the swivel axis X.

The flange unit 17 desirably projects a minimum amount forward from the swivel base 2 in order to keep a good fore and aft balance of the swivel base 2. Thus, it is required to set the distance L1 not to be greater than the distance L2.

The boom 20 is bent at an intermediate portion thereof. A mounting bracket 20A is secured to an outer surface of the bent portion. The boom cylinder 21 has the proximal end of a tube thereof pivotably supported by the mounting bracket 20A. The boom cylinder 21 is provided outwardly of a rear surface of the boom 20.

The control box 6 is disposed as forwardly on the swivel base 2 as possible, but not contacting the boom cylinder 21 in a position shown in FIG. 1 with the rear surface of the boom 20 extending substantially parallel to the boom cylinder 21. The flange unit 17 projects only a small amount from the swivel base 2, so that the front surface of the control box 6 lies dose in the fore and aft direction to a vertical shaft receiving portion 18A of the swing bracket 18.

Figure 6:
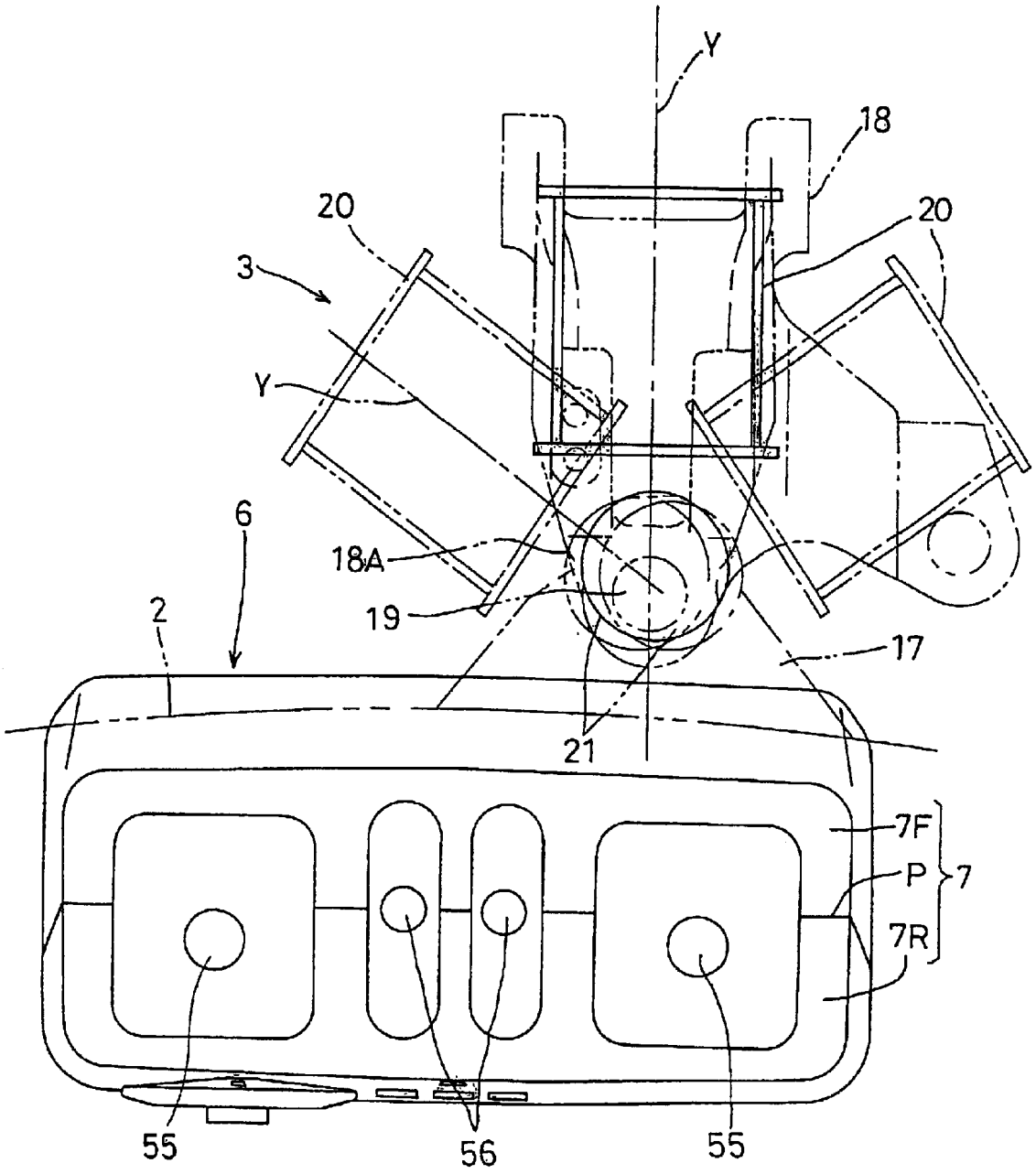
FIG. 6 is an explanatory plan view showing a relationship between the control box and a boom.

As shown in FIG. 6, the boom 20 has a cross section with an aspect ratio substantially of 1 to 1. Where the tube base end of the boom cylinder 21 is inserted into the boom 20 for pivotal support, the rear surface of the boom 20 is bored and thus the boom is required to have a large width to secure strength. On the other hand, when the boom cylinder 21 is disposed outside the rear surface of the boom 20, sufficient strength is secured even if the boom has a small width.

FIG. 6 shows the boom 20 swung sideways about 60 degrees in a dot-and-dash line and a two-dot-and-dash line, respectively. The boom cylinder 21 has smaller sideways dimensions than the boom 20, and the boom 20 has a small width as described above. Thus, the boom 20 and boom cylinder 21, when swung, protrude only a small amount rearward from the boom center Y.

Specifically, as the boom cylinder 21 is provided rearwardly of the boom 20 and the boom 20 is formed with a reduced width, the boom 20 may have a large swing angle, the distance from the front end of the swivel base 2 to the vertical shaft 19 may be reduced, the control box 6 may project an increased amount forward from the front end of the swivel base 2, and/or the front ends of the swivel base 2 and control box 6 may be positioned further remote from the swivel axis X. Consequently, the width between the driver's seat 5 and control box 6 may be increased easily while maintaining the good fore and aft weight balance of the swivel base 2, as a result of which the satisfactory walk-through space 100 is secured.

The foregoing backhoe 1 has various structural features to reduce the entire size while securing the minimum required walk-through space 100.

That is, the driver's seat 5 has a size required for driving, distances from the driver's seat 5 to the control levers 55 and the running control levers 56 are properly determined, and the engine 38 having a required power output, the fuel tank 39 and oil tank 40 having proper capacities, hydraulic pumps 41, radiator 42 and battery 43 are arranged on the swivel base 2. These components are enclosed in the smallest possible hood 44 on which the driver's seat 5 is mounted.

In the fore and aft direction, the rear end of the driver's seat 5 substantially coincides with the rear ends of the hood 44 and balance weight 37 defining the rearmost end of the swivel base 2. The front end of the driver's seat 5 is located rearwardly of the front end of the hood 44, and the front portion of the hood 44 is positioned forwardly of the swivel axis X to set the front end of the driver's seat 5 close to the swivel axis X.

In the transverse direction, the hood 44 and swivel base 2 have a slightly larger width than the driver's seat 5. The swivel base 2 has a square front half and a rear half with a rounded end. The control box 6 is disposed substantially in the transversely middle position at the front end of the swivel base 2, while the flange unit 17 is provided rightward from the middle of the front surface of the swivel base 2.

In order to minimize the size of the backhoe 1 while securing required functions, the backhoe having the above-described features employs the following structures also.

The boom cylinder 21 is disposed outside the rear surface of the boom 20. Thus, the boom cylinder 21 smaller in width than the boom 20 lies close to the control box 6. The boom cylinder 21 is not inserted into the boom 20 through the rear surface thereof, but is provided outside the boom 20 in order to realize a reduced width of the boom 20. Particularly, the boom 20 has a cross section with an aspect ratio of 1 to 1, which realizes the boom having a width sufficiently smaller than in the prior art. All this allows the boom 20 and boom cylinder 21 to be positioned as close to the front surface of the control box 6 as possible, the boom 20 to have a sufficient swing angle, and the control box 6 to be positioned further forward.

The distance L1 from the swivel axis X to the vertical shaft 19 is substantially the same as the distance L2 from the swivel axis X to the rear end of the swivel base 2. The distance L2 from the swivel axis X to the rear end of the swivel base 2 and the distance from the driver's seat 5 or the hood 44 to the swivel axis X are reduced as much as possible. As a result, the distance L1 to the vertical shaft 19 is decreased to maintain the good fore and aft balance of the swivel base 2. This ultra-small swivel type working vehicle has a reduced maximum swiveling radius.

Furthermore, the front surface of the control box 6 is positioned close to the vertical shaft receiving portion 18A of the swing bracket 18. The vertical shaft receiving portion 18A of the swing bracket 18 is positioned close to the control box 6 positioned relative to the driver's seat 5. It is thus possible to keep the good fore and aft balance of the swivel base 2 and reduce the maximum swiveling radius for the ultra-small swivel type working vehicle. While the control box 6 is positioned further forward than in the prior art, the accommodation space and walk-through space 100 forwardly of the driver's seat 5 are enlarged.

Still further, the front surface of the control box 6 bulges forward from the front end of the swivel base 2 and thus the accommodation space between the driver's seat 5 and control box 6 may be enlarged by the amount of forward bulging to facilitate walk-through movement. The swivel base 2 may be downsized in a corresponding relationship to the amount of forward bulging of the control box 6, which realizes compactness of the swivel base 2.

As the vertical center line 9S of the control valve assembly 9 is displaced forward from the center line 8S of the pilot valve assembly 8 to form the convex front surface of the control box 6, the rear surface of the control box 6 may be formed concave to enlarge the space between the driver's seat 5 and the control box 6. As a result, the satisfactory walk-through space 100 is secured.

What is claimed is:

1. A small swivel type working vehicle comprising:

a running device;

a swivel base mounted on said running device to be swivelable about a vertical swivel axis;

a driver's seat mounted on said swivel base;

a control box mounted upright on a top surface of said swivel base forwardly of said driver's seat;

a swing bracket pivotally supported by a flange unit provided at a front end of said swivel base to be swingable about a vertical pivotal axis;

a boom pivotally supported to be swingable about a horizontal shaft by said swing bracket, said boom being in a form of a substantially hollow rectangular box; and a boom cylinder connected to said swing bracket at one end thereof and to said boom at the other end for swinging said boom, said boom cylinder being provided outside said boom to extend along a rear surface of the rectangular box, wherein said swing bracket is disposed above said running device, said vertical pivotal axis of said swing bracket being positioned rearwardly of a front roller axis of a crawler running device constituting said running device, a rear end of said swivel base substantially coincides with a rear roller axis of said crawler running device, a distance from said swivel axis of said swivel base to said vertical pivotal axis of said swing bracket is substantially the same as a distance from said swivel axis to a rear end of said swivel base, and said control box and said driver's seat define a walk-through space therebetween for allowing the driver to board and alight from the vehicle at opposite lateral sides of said swivel base.

2. A small swivel type working vehicle as defined in claim 1, wherein said control box has a front end positioned between said vertical pivotal axis and a front end of said swivel base.

3. A small swivel type working vehicle as defined in claim 1, wherein said control box has a front surface convexed to project radially outwardly of a contour of said swivel base, and a rear surface concaved to be away from said driver's seat.

4. A small swivel type working vehicle as defined in claim 1, wherein said rectangular box of said boom has a cross section with an aspect ratio substantially of 1 to 1.

5. A small swivel type working vehicle as defined in claim 1, wherein said control box includes a pair of right and left frame side plates fixed to said swivel base at lower ends thereof, a control valve assembly mounted in an intermediate portion of an equipment accommodating space produced by said pair of right and left frame side plates, a manifold disposed above said control valve assembly, and a control device disposed above said manifold.

6. A small swivel type working vehicle as defined in claim 5, wherein said control device includes a pair of right and left levers fixed to a frame upper plate supported by said pair of right and left frame side plates.

7. A small swivel type working vehicle as defined in claim 5, wherein said control valve assembly has a vertical center line displaced forwardly of a center line of said control device, and wherein each of said frame side plates has an upper portion displaced rearwardly of a lower portion thereof and an intermediate portion displaced forwardly of said lower portion.

8. A small swivel type working vehicle as defined in claim 5, wherein said control valve assembly has spools oriented vertically, and wherein pipes connecting said control valve assembly to said control device extend forwardly and upwardly of said control valve assembly.

9. A small swivel type working vehicle comprising:

a running device;

a swivel base mounted on said running device to be swivelable about a vertical swivel axis;

a driver's seat mounted on said swivel base;

a control box mounted upright on a top surface of said swivel base forwardly of said driver's seat, wherein said control box and said driver's seat define a walk-through space therebetween for allowing the driver to board and alight from the vehicle at opposite lateral sides of said swivel base;

a swing bracket pivotally supported by a flange unit provided at a front end of said swivel base to be swingable about a vertical pivotal axis;

a boom pivotally supported by said swing bracket to be swingable about a horizontal shaft; and a boom cylinder connected at one end thereof to said swing bracket and at the other end to said boom for swinging said boom, said boom cylinder being provided outside said boom to extend along a rear surface thereof, wherein a distance from said swivel axis of said swivel base to said vertical pivotal axis is substantially the same as a distance from said swivel axis to a rear end of said swivel base, and said control box has its front surface convexed to project radially outwardly of a contour of said swivel base, and its rear surface concaved to be away from said driver's seat.

10. A small swivel type working vehicle as defined in claim 9, wherein a control valve assembly is disposed in an intermediate position of said control box, and wherein displacing said control valve assembly toward said front surface of said control box makes said rear surface of said control box concaved.

11. A small swivel type working vehicle as defined in claim 10, wherein said control box includes a pair of right and left frame side plates fixed to said swivel base at lower ends thereof, said control valve assembly mounted in an intermediate portion of an equipment accommodating space produced by said pair of right and left frame side plates, a manifold disposed above said control valve assembly, and a control device disposed above said manifold.

12. A small swivel type working vehicle as defined in claim 11, wherein said control device includes a pair of right and left levers fixed to a frame upper plate supported by said pair of right and left frame side plates.

13. A small swivel type working vehicle as defined in claim 11, wherein said control valve assembly has a vertical center line displaced forwardly of a center line of said control device, and each of said frame side plates has an upper portion displaced rearwardly of a lower portion thereof and an intermediate portion displaced forwardly of said lower portion.

14. A small swivel type working vehicle as defined in claim 11, wherein said control valve assembly has spools oriented vertically, and pipes connecting said control valve assembly to said control device extend forwardly and upwardly of said control valve assembly.

15. A small swivel type working vehicle as defined in claim 9, wherein said control box has a front end positioned between said vertical pivotal axis and a front end of said swivel base.

16. A small swivel type working vehicle as defined in claim 9, wherein said boom is in form of a substantially hollow rectangular box having a cross section with an aspect ratio substantially of 1 to 1.

17. A small swivel type working vehicle as defined in claim 9, wherein said swing bracket is disposed above said running device, and said vertical pivotal axis is positioned rearwardly of a front roller axis of a crawler running device constituting said running device.

18. A small swivel type working vehicle as defined in claim 9, wherein said rear end of said swivel base substantially coincides with a rear roller axis of said crawler running device.

* * * * *